US005669457A

United States Patent [19]

Sebastian et al.

[11] Patent Number: 5,669,457

[45] Date of Patent: Sep. 23, 1997

[54] DRILL STRING ORIENTING TOOL

[75] Inventors: Danny S. Sebastian, Houston; Thomas R. Beasley, Katy, both of Tex.

[73] Assignee: Dailey Petroleum Services Corp., Conroe, Tex.

[21] Appl. No.: 581,772

[22] Filed: Jan. 2, 1996

[51] Int. Cl.[6] ..... E21B 7/04

[52] U.S. Cl. ..... 175/73; 166/117.7; 175/256; 175/322

[58] Field of Search ..... 175/73, 322, 256; 166/117.7

[56] References Cited

U.S. PATENT DOCUMENTS

| | | | |
|---|---|---|---|
| Re. 33,751 | 11/1991 | Geczy et al. | 175/61 |
| 4,899,835 | 2/1990 | Cherrington | 175/73 X |
| 4,938,297 | 7/1990 | Schmidt | 173/91 |
| 4,957,173 | 9/1990 | Kinnan | 175/73 X |
| 5,050,692 | 9/1991 | Beimgraben | 175/61 |
| 5,156,223 | 10/1992 | Hipp | 175/222 X |
| 5,215,151 | 6/1993 | Smith et al. | 175/222 X |
| 5,273,123 | 12/1993 | Bardin et al. | 175/74 |
| 5,314,032 | 5/1994 | Pringle et al. | 175/74 |
| 5,316,093 | 5/1994 | Morin et al. | 175/73 |
| 5,316,094 | 5/1994 | Pringle | 175/322 X |
| 5,339,913 | 8/1994 | Rives | 175/73 |
| 5,343,966 | 9/1994 | Wenzel et al. | 175/74 |
| 5,368,109 | 11/1994 | Pittard, Jr. et al. | 175/45 |
| 5,448,227 | 9/1995 | Orban et al. | 175/40 |
| 5,450,914 | 9/1995 | Coram | 175/73 |

OTHER PUBLICATIONS

"FT North Sea Letter"; Feb. 15, 1995; U.S.

"Sperry–Sun Drilling Services Advertisement"; Nov. 1994; U.S.

"Coiled Tubing Drilling Tool Article"; date unknown; U.S.

"Radius, Inc. Sales Brochure"; date unknown; U.S.

*Primary Examiner*—Hoang C. Dang

*Attorney, Agent, or Firm*—Arnold & White & Durkee

[57] ABSTRACT

A drill string orienting tool for insertion into a well bore includes a housing that has a plurality of inwardly projecting splines. A mandrel is disposed within the housing. The orienting tool has two operating positions, a running position, and an orienting position. The housing is longitudinally moveable relative to the mandrel between the running position and the orienting position. The mandrel and the housing define an annular chamber that is vented to the exterior of the housing. A flexible metallic coiled tube is disposed within the annular chamber and contains hydraulic fluid. The upper end of the coiled tube is coupled to the housing and is in fluid communication with the first fluid chamber. The lower end of the coiled tube is coupled to the mandrel. The mandrel has outwardly projecting splines that are engageable with a corresponding set of inwardly projecting splines on the housing when the orienting tool is in the running position. A piston is movably disposed within the housing. The piston and the housing define a first fluid chamber, and a second fluid chamber. The second fluid chamber is vented to the exterior of the housing. Downward movement of the piston causes a positive pressure differential between the pressure inside the coiled tube and the pressure outside the coiled tube, thereby causing the coiled tube to uncoil and rotate the mandrel relative to the housing.

14 Claims, 6 Drawing Sheets

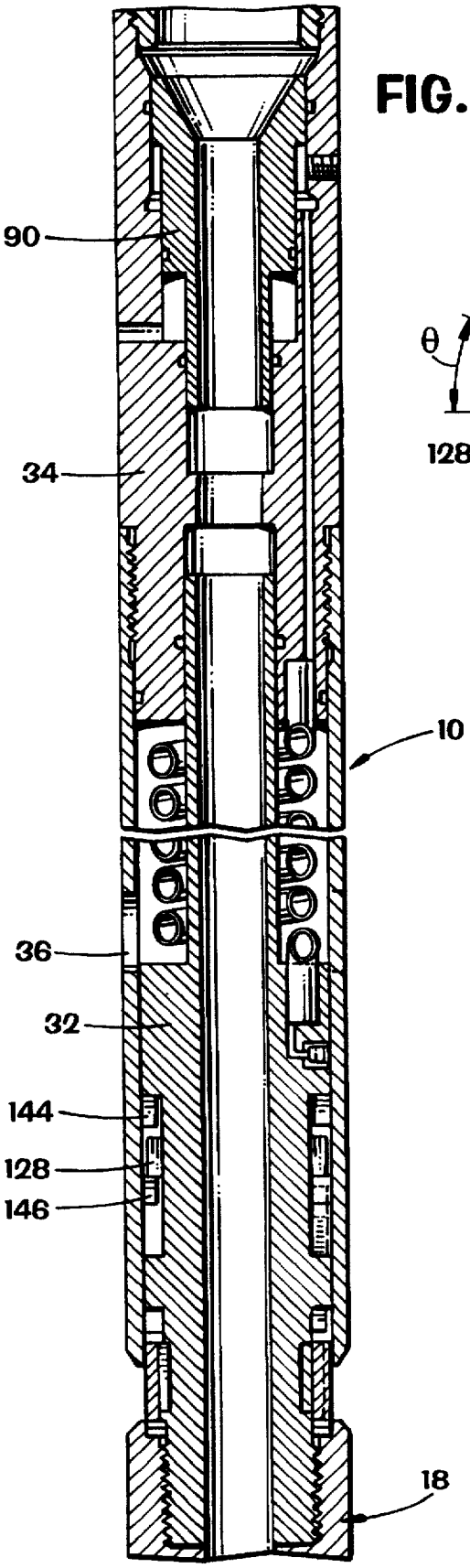
FIG. 3
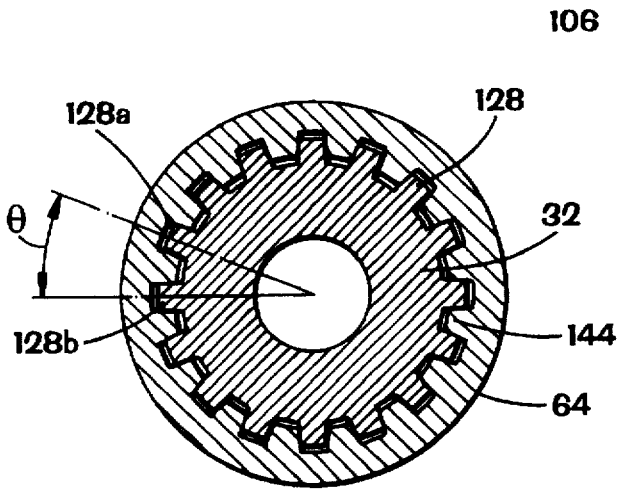
FIG. 4
FIG. 5
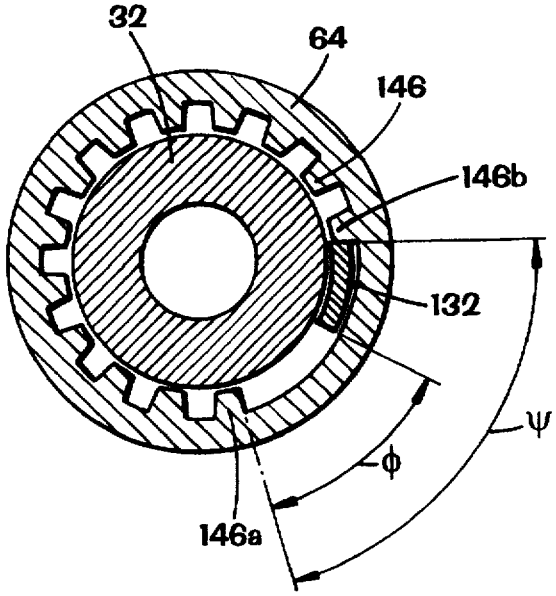

FIG. 6
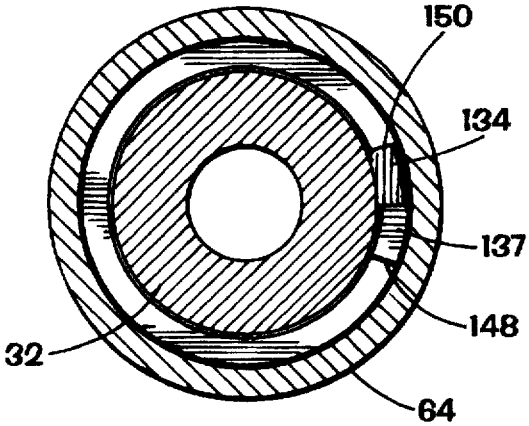
FIG. 8
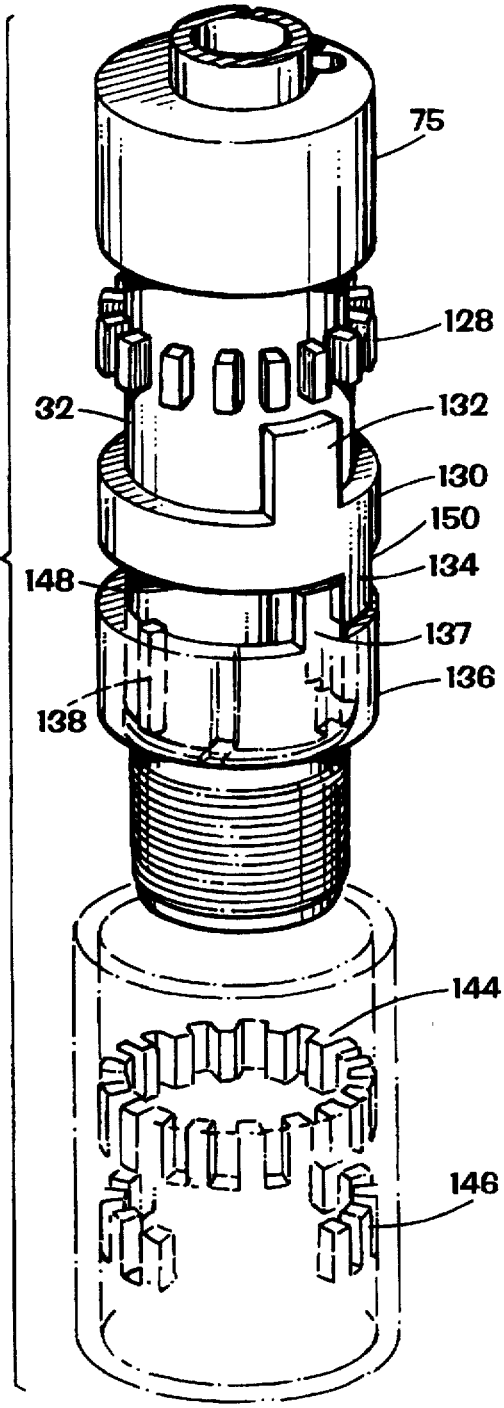
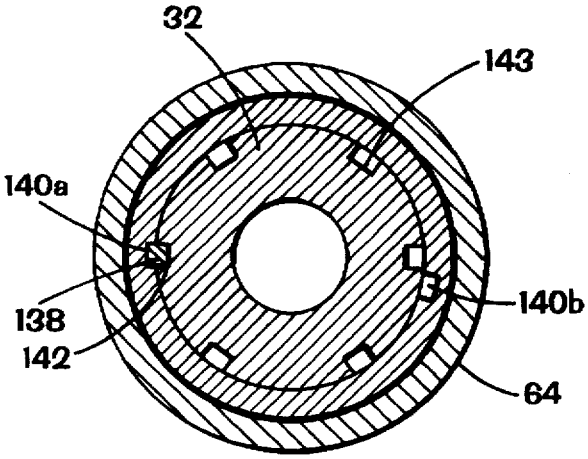
FIG. 7

DRILL STRING ORIENTING TOOL

BACKGROUND OF THE INVENTION

1. Field of the Invention

This invention relates generally to an orienting tool for effecting relative rotational movement between two subs in a drill string. More particularly, this invention relates to an orienting tool for effecting relative rotational movement between two subs in a drill string wherein the orienting tool utilizes one or more flexible metallic tubes, such as bourdon tubes, to implement the relative rotational movement.

2. Description of the Related Art

Directional drilling involves the deliberate deviation of a well bore by selective manipulation of the drill string. The capability to directionally drill has enabled operators to realize certain efficiencies such as the ability to drill many bore holes from a single platform location, and to avoid difficult subsurface formations.

Two techniques have traditionally been used for selectively deviating the drilling path of a drill string. One method involves the installation of an adjustable bent sub in the bottomhole assembly proximate the drilling motor. The bending movement of the adjustable bent sub, which typically ranges from a fraction of a degree to about three degrees, changes the inclination of the drill bit relative to the axis of the existing well bore. In another commonly utilized method, an outwardly projecting stabilizer, otherwise known as a heel, is incorporated into the exterior of the drill motor bearing housing, and used in conjunction with the aforementioned adjustable bent sub. The stabilizer interferes with the wall of the well bore, resulting in a force component acting on the stabilizer in a direction that is approximately normal to the longitudinal axis of the well bore. The force acting on the stabilizer urges the drill bit in a direction opposite from the point of interaction between the well bore and the stabilizer. The drill bit will normally have a tendency to deviate away from the point of interaction between the well bore and the stabilizer. Thus, by rotating the drill string relative to the bore hole to change the point of interaction between the stabilizer and the well bore, the drill bit's path may be deviated in a variety of directions.

For drill strings utilizing ordinary drill pipe, this relative rotational movement may be simply a matter of rotating the drill string the desired amount from the surface. However, in coiled tubing applications, the structural limitations of the tubing prohibit rotation of the drill string relative to the well bore by rotating the coiled tubing. Accordingly, in coiled tubing applications, the motor bearing housing must be rotated without rotating the coiled tubing.

Some existing techniques for facilitating relative rotational movement between the motor bearing housing and the well bore in coiled tubing applications involve the use of a hydraulic actuating mechanism to rotate the drill string. The hydraulic actuating mechanism requires two hydraulic fluid supply lines that extend from the surface down to the drill string to supply pressurized hydraulic fluid to the mechanism. Pressure applied from one supply line facilitates movement in one direction, and pressure applied from the other supply line facilitates rotational movement in the opposite direction. The necessity of two separate high pressure hydraulic fluid lines adds significant expense to drilling operations, and the riggers of the down-hole environment may subject the hydraulic lines to catastrophic failure.

In other existing techniques, a ratchet mechanism in the bottomhole assembly is used to rotate the bearing housing.

The ratchet mechanism typically utilizes one or more J-slots and keys that rotate the bearing housing a certain angle each time the bottomhole assembly is lifted and then lowered. Since the bottomhole assembly in a typical drilling operation is lifted and lowered many times for reasons other than changing the position of the stabilizer, the bearing housing may be moved away from the desired position. In such cases, the bottomhole assembly must be cycled up and down until the ratchet mechanism rotates the bearing housing back to the desired position. In such situations, an accurate count of the number of cycles must be kept, or the bit will be steered off course.

The present invention is directed to overcoming one or more of the foregoing disadvantages.

SUMMARY OF THE INVENTION

In one aspect of the present invention, a tool for effectuating relative rotational movement between two spaced apart sections of a drill string is provided. The tool includes a housing, a mandrel that has a first end disposed within the housing, and a flexible metallic coiled tube disposed within the housing and containing a fluid. The tube has a first end coupled to the housing and a second end coupled to the mandrel. The tube is operable to selectively rotate the mandrel relative to said housing in response to a change in the pressure of the fluid.

In another aspect of the present invention an orienting tool for insertion into a well bore is provided. The orienting tool includes a housing that has a fluid passage disposed therein, and a mandrel that has a first end disposed within the housing. The mandrel and the housing define an annular chamber that is vented to the exterior of the housing. A flexible metallic coiled tube is disposed within the annular chamber. The coiled tube has a first end coupled to the housing that is in fluid communication with a fluid passage and a second end coupled to the mandrel. The tube is operable to rotate the mandrel relative to the housing in response to a change in the pressure of the fluid. A piston is movably disposed within the housing. The piston and the housing define a first fluid chamber. The first fluid chamber is in fluid communication with the fluid passage, wherein longitudinal movement of the piston effects the change in the pressure of the fluid.

In still another aspect of the present invention an orienting tool that has an uphole end and a downhole end for insertion into a well bore is provided. The orienting tool includes a housing that has a plurality of inwardly projecting splines. A mandrel is provided that has a first end disposed within the housing, and a second end that is adapted for coupling to a downhole tool. The housing is longitudinally moveable relative to the mandrel between a running position and an orienting position. The mandrel and the housing define an annular chamber that is vented to the exterior of the housing. The mandrel has one outwardly projecting spline that is adapted to be selectively disposed between any two of the plurality of inwardly projecting splines when the mandrel is in the running position. A flexible metallic coiled tube is disposed within the annular chamber and contains a fluid. The tube has a first end coupled to the housing and in fluid communication with the first fluid chamber, and a second end coupled to the mandrel. The tube is operable to rotate the mandrel relative to the housing in response to a change in the pressure of the fluid. A piston is movably disposed within the housing. The piston and the housing define a first fluid chamber and a second fluid chamber. The second fluid chamber is vented to the exterior of the housing. Longitudinal movement of the piston effectuates the change in pressure of the fluid. dr

BRIEF DESCRIPTION OF THE DRAWINGS

Other objects and advantages of the invention will become apparent upon reading the following detailed description and upon reference to the drawings in which:

FIG. 3 illustrates the drill string orienting tool, in section, and positioned in an orienting position.

FIGS. 4 illustrates a sectional view of FIG. 2 at section 4—4.

FIG. 5 illustrates a sectional view of FIG. 2 at section 5—5.

FIG. 6 illustrates a sectional view of FIG. 2 at section 6—6.

FIG. 7 illustrates a sectional view of FIG. 2 at section 7—7.

FIG. 8 illustrates the mandrel and a portion of the housing from the orienting tool, in an exploded pictorial view.

DESCRIPTION OF THE PREFERRED EMBODIMENTS

Figure 1:
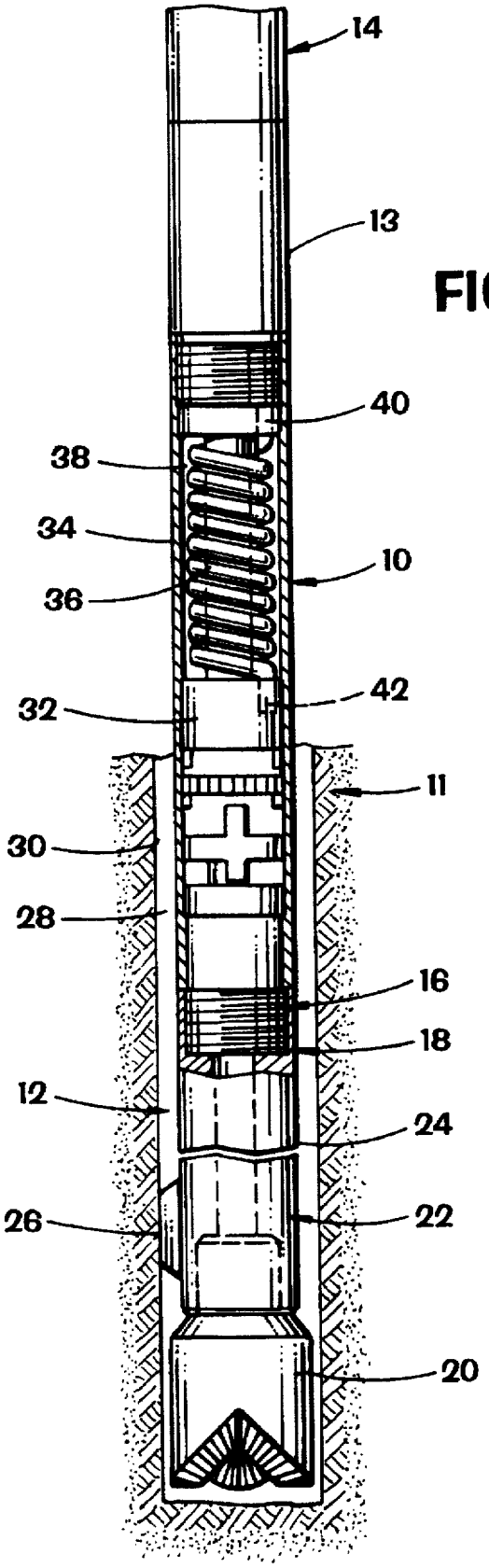
FIG. 1 illustrates a drill string orienting tool, in partial section, deployed in a bottomhole assembly.

Referring now to the drawings, and particularly to FIG. 1, there is shown an orienting tool 10 that is adapted to be coupled between two components of a typical bottomhole assembly 11 utilized in a well bore 12. The orienting tool 10 is coupled at its upper end 13 to an upper component 14 of the bottomhole assembly, which may be a section of straight pipe or some other type of downhole tool, and at its lower end 16 to a lower component 18 of the bottomhole assembly 11, which is normally a MWD (measurement while drilling) sub. As is readily apparent, the lower end of the bottomhole assembly 11 terminates in a drill bit 20 that emanates from a bearing housing 22, which is ordinarily the lower end of a mud motor. The length of the bearing housing 22 and the other components of the bottomhole assembly 11 that may be included between the orienting tool 10 and the drill bit 20 necessitates that the bearing housing 22 be shown broken as indicated at 24. The bearing housing 22 has one or more stabilizers 26 that project radially outward in the annulus 28 to engage the wall 30 of the well bore 12. As is typical of bottomhole assemblies, the bottomhole assembly 11 will have a working fluid, such as drilling mud, conveyed therethrough, and discharged into the bore 12 through one or more orifices (not shown) in the drill bit 20.

As discussed in more detail below, the orienting tool 10 consists of an inner tubular mandrel 32 telescopingly supported inside an outer tubular housing 34. The mandrel 32 is preferably unitary in construction while the tubular housing 34 consists of a plurality of tubular segments joined together, preferably by threaded inner connections. The mandrel 32 is capable of selectively sliding longitudinally, and rotating, relative to the tubular housing 34. A helically coiled tube 36 is coiled around a portion of the mandrel 32 within an annular chamber 38 between the tubular housing 34 and the mandrel 32. The upper end 40 of the coiled tube 36 is coupled to the tubular housing 34 and the lower end 42 of the coiled tube 36 is coupled to the mandrel 32. The coiled tube 36 contains a relatively incompressible fluid, such as hydraulic fluid. As discussed more fully below, by changing the pressure of the hydraulic fluid, the coiled tube 36 will expand or contract as the case may be, causing a relative rotational movement between the mandrel 32 and the tubular housing 34, thereby rotating the lower component 22 of the bottomhole assembly relative to the upper component 14.

The detailed structure of the orienting tool 10 may be understood by reference to FIGS. 2–8. The orienting tool 10 has two distinct operating positions, a running position depicted in FIG. 2, wherein relative rotational movement between the mandrel 32 and the tubular housing 34 is prevented, and an orienting position depicted in FIG. 3, wherein relative rotational movement between the mandrel 32 and the tubular housing 34 is permitted.

Figure 2:
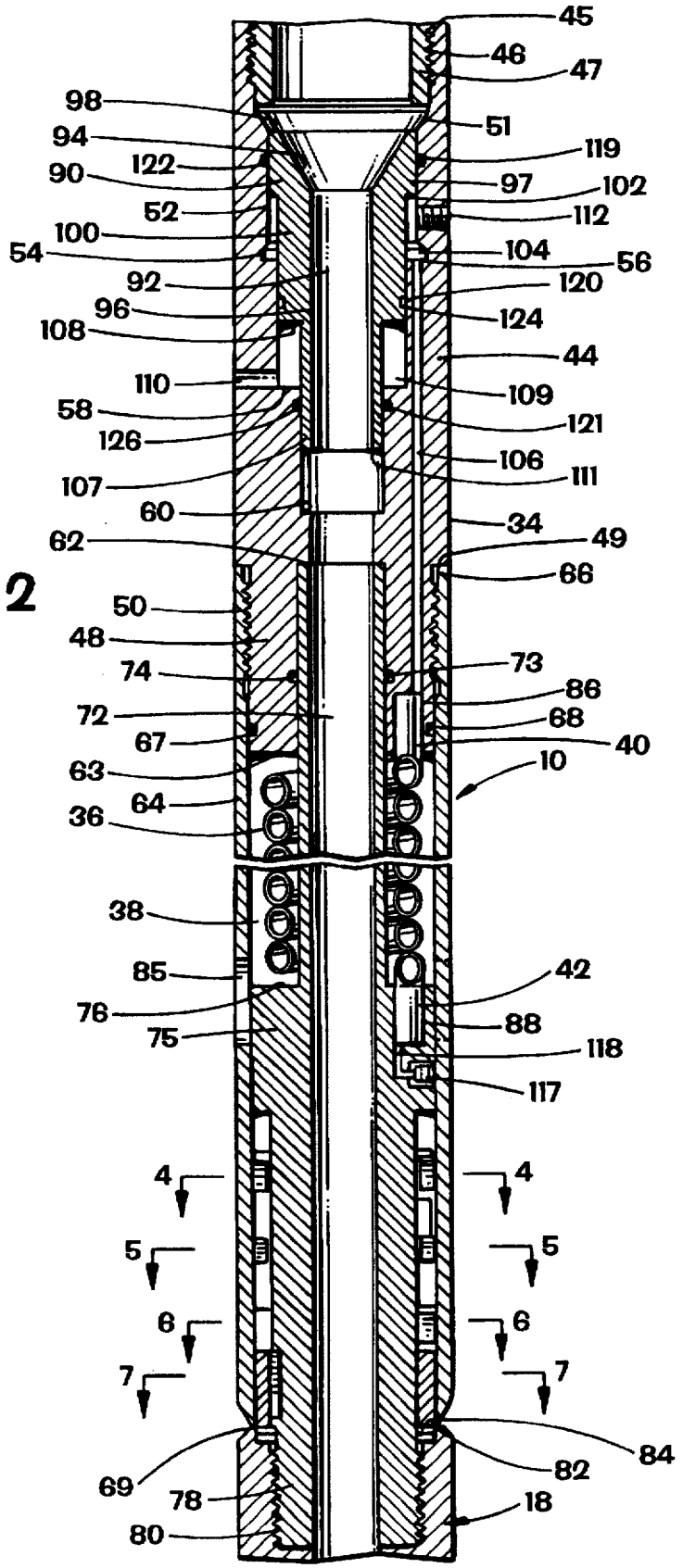
FIG. 2 illustrates the drill string orienting tool, in section, and positioned in a running position.

Referring now to FIG. 2, the tubular housing 34 is formed in several sections for purposes of assembly. The upper end of the tubular housing 34 consists of an upper tubular portion 44. The upper end of the upper tubular portion 44 has a substantially flat upward facing surface 45 and is internally threaded at 46 for engagement with the lower end of the upper component 14, which, in this case, is in the form of a pin 47. The lower portion of the upper tubular portion 44 is provided with a pin 48 that has a shoulder 49. The pin 48 is externally threaded at 50. The interior wall of the upper tubular portion 44 tapers inward at 51 to form a reduced diameter portion 52 of the upper tubular portion 44. The lower end of the reduced diameter portion 52 tapers radially outward to form an annular recess 54. The lower surface of the annular recess 54 provides an upwardly facing annular shoulder 56.

The central section of the upper tubular portion 44 has a portion of reduced diameter forming an upwardly facing annular shoulder 58, that is followed by a potion of increased diameter forming an upwardly facing shoulder 60, that is, in turn, followed by a portion of reduced diameter forming an downwardly facing shoulder 62. The shoulder 62 defines the limit of upward movement of the mandrel 32. The lower end of the upper tubular portion 44 terminates in a downwardly facing substantially flat bottom 63.

The tubular housing 34 is provided with a lower tubular portion 64 that is internally threaded at its upper end for connection to the threaded portion 49 of the pin 48. The upper end portion of the lower tubular portion 64 has a shoulder 66 which abuts the shoulder 49 of the upper tubular portion 44 when the threaded connection at 50 and 65 is securely tightened. An O-ring 67 is disposed in an annular recess 68 in the lower end of the upper tubular portion 44 to provide a fluid seal for the threaded connection between the upper tubular portion 44 and the lower tubular portion 64. The lower end of the lower tubular portion 64 terminates in a downwardly facing shoulder 69. The interior surface of the lower end of the lower tubular portion 64 is provided with an inwardly facing arrangement of splines that is designed to cooperatively engage one or more outwardly projecting splines on the mandrel 32 as discussed more fully below.

The mandrel 32 consists of an upper tubular portion 70 having an inner longitudinal passage 72 extending therethrough for conveying working fluid to the lower component 18 and eventually to the drill bit 20. The upper end of the upper tubular portion 70 is slidably disposed within the lower end of the upper tubular portion 44. Leakage of working fluid from the passage 72 is prevented by a dynamic seal 73 disposed in an annular recess 74 in the counter bore 48. The lower end of the upper tubular portion 70 transitions into a larger diameter intermediate section 75 forming an upwardly facing substantially flat shoulder 76. The intermediate section 75 is in sliding contact with the interior surface of the lower tubular portion 64. The mandrel 32 is provided with a lower tubular portion 78 emanating from the lower tubular portion 64, that is externally threaded, as indicated at 80, for engagement with the lower component 18. The downwardly facing should 69 abuts an upwardly facing shoulder 82 on the lower component 18. A snap ring 84 is slipped over the lower end 78. The function of the snap ring 84 is describe below.

The interior surface of the lower tubular portion 64 and the exterior surface of the upper tubular portion 70 of the mandrel 32 cooperatively define the annular chamber 38 in which the coiled tube 36 is disposed. The central portion of the lower tubular portion 64 includes one or more circumferentially spaced ports 85 that enable fluid communication between the annular chamber 38 and the well annulus 28.

The upper end 40 of the coiled robe 36 is a generally vertically oriented elongated nipple disposed in a bore 86 in the lower end of the upper tubular portion 44. The lower end 42 is a generally vertically oriented nipple that is rigidly disposed in a bore 88 in the intermediate section 75. It is anticipated that significant stresses may be imparted on the coiled tube 36 at the intersections between the upper end 40 and the substantially flat bottom 63 of the upper tubular portion 44 and the lower end 42 and the substantially flat upward shoulder 76 of the intermediate section 75. Accordingly, it is preferable that the upper and lower ends 40 and 42 be attached to the upper tubular portion 44 and the intermediate section 75 by silver soldering or similar attachment methods.

The coiled tube 36 functions to impart a torque on the mandrel 32 in response to a differential between the pressure inside the robe 36 and the pressure in the annulus 28. It should be understood that the coiling and uncoiling movements of the coiled tube 36 are influenced by the difference between the hydraulic fluid pressure acting on the interior of the coiled tube 36 and the working fluid pressure in the annular chamber 38 acting on the exterior of the coiled tube 36, and by the stiffness of the robe 36. When the fluid pressure inside the coiled robe 36 exceeds the fluid pressure in the annular chamber 38 to an extent that will elastically deform the tube 36, the coiled robe 36 will be urged to uncoil. In this way, the coiled tube 36 behaves similarly to a bourdon tube of the type used in various types of gauges, in that, the coiled tube 36 will have a tendency to uncoil in response to a positive pressure differential relative to the annulus 28, and coil in response to a reduced pressure differential relative to the annulus 28.

As the coiled tube 36 uncoils, it will increase in diameter and the spacing between each individual coil will increase. Accordingly, the thickness of the annular chamber 38 should be chosen to accommodate the anticipated maximum increase in diameter of the coiled tube 36.

Throughout this application, the frame of reference for clockwise and counterclockwise directions is looking downhole from the surface. The coiled tube 36 shown in FIG. 2 is a left hand coil as viewed from uphole. Accordingly, a positive pressure differential will urge the tube 36 to uncoil in a clockwise direction thereby imparting a clockwise torque to the mandrel 32. The clockwise torque will rotate the mandrel 32 in a clockwise direction when the orienting tool 10 is in the orienting position. Conversely, a reduced pressure differential will allow the coiled tube 36 to coil and impart a torque to the mandrel 32 in a counterclockwise direction. If the orienting tool 10 is in the orienting position, the mandrel 32 will rotate counterclockwise in response to the counterclockwise torque.

The diameter and cross-section of the tube 36, as well as the number, diameter and particular cross-section, of the individual coils in the coiled tube 36 will be a matter of discretion on the pan of the designer. However, it is anticipated that the cross-section of the tube 36 itself should be chosen to avoid abrupt angles or small radii that may lead to stress risers. The coiled tube 36 will be exposed to relatively high pressures, potentially high temperatures depending upon the conditions in the annulus, and materials present within the annulus 28, as well as alternating stresses associated with repeated clockwise and counterclockwise movements. Accordingly, the coiled tube 36 is preferably composed of a material with sufficient strength, and fatigue and corrosion resistance to withstand the anticipated operating conditions. A typical preferred material is Inconel X.

To achieve the desired pressure differentials between the pressure in the tube 36 and the pressure in the annular chamber 38, the upper tubular portion 44 is provided with a piston 90 that is capable of longitudinal movement to selectively change the pressure of the fluid in the tube 36. The piston 90 is provided with an interior flow passage 92 extending longitudinally therethrough to permit flow of working fluid into the flow passage 72. The upper end of the interior flow passage 92 consists of an inwardly tapering upper section 94 that joins a smaller diameter cylindrical lower section 96.

The piston 90 is provided with an upper tubular portion 97 that slidingly contacts the diameter of the reduced diameter portion 52. The upper end of the upper tubular portion 97 has a substantially flat upwardly facing annular surface 98. The annular surface 98 and the upper section 94 have a combined pressure area $A_{94}$ upon which the pressure of the working fluid may act.

The lower end portion of the upper tubular portion 94 transitions into an intermediate portion 100 having a reduced diameter that forms a downwardly facing annular shoulder 102. The annular shoulder has a surface area $A_{102}$. The intermediate portion 100, the reduced diameter portion 52, the annular recess 54, and the opposing shoulders 102 and 56 cooperatively define an annular chamber 104. A flow passage 106 extends from the annular chamber 104 longitudinally through the upper tubular portion 44 to the upper end 40 of the coiled tube 36 to permit fluid communication between the annular chamber 104 and the coiled tube 36. The intermediate portion 100 transitions at its lower end to a lower tubular portion 107 forming a downwardly facing shoulder 108 with a surface area $A_{108}$. The lower tubular portion 107 terminates in a downwardly facing annular shoulder 111 which has a surface area $A_{111}$. The shoulder 108, the lower tubular portion 107, and the shoulder 58 define an annular chamber 109 that is vented to the annulus 28 by a port 110. The lower limit of movement of the piston 90 is defined by the interactions between the downwardly facing annular shoulder 102 and the upwardly facing annular shoulder 56, by the upward facing annular shoulder 58 and the downwardly facing annular shoulder 108, and between the upwardly facing annular shoulder 60 and the annular shoulder 111.

Figure 13:
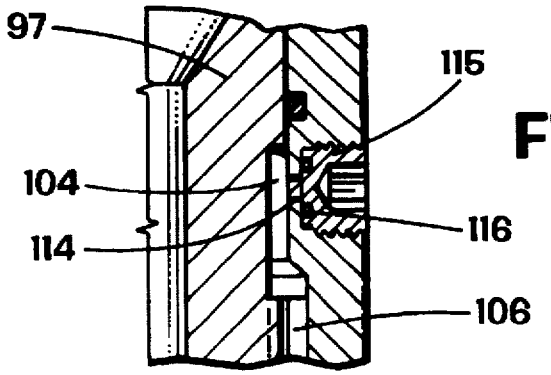
FIG. 13 illustrates a detailed view from FIG. 2, in section, and showing the structure of the hydraulic fluid fill port.

The upper tubular portion 44 has a fill port 112 as to enable the operator to fill the tube 36, the annular chamber 104, and the flow passage 106 with hydraulic fluid. The details of the fill port 112 may be better seen in FIG. 13. The fill port 112 is counter sunk to provide a fill passage 114 leading to the annular chamber 104, and a larger diameter opening that is capped by a threadedly connected plug 115. The plug 115 has an O-ring seal 116 that engages the upper tubular potion 44 proximate the fill passage 114.

A bleed port 117 identical to the fill port 112 is disposed in the intermediate section 75 of the mandrel 32. The bleed port 117 is in fluid communication with the tube 36 via a passage 118.

The tube 36 is filled while the bleed 117 is elevated above the fill port 112, and prior to installation of the lower tubular portion 64. Hydraulic fluid is pumped into the fill port 112 and any gases trapped in the tube 36 or annular chamber 104 are permitted escape through the bleed port 117. After filling, the lower tubular potion 64 is installed.

It should be understood that it is desirable to prevent leakage of fluids past the piston 90, such as hydraulic fluid from the flow passage 106, or infiltration of working fluid past the piston 90, in order to maintain pressure in the tube 36 and to avoid contaminating the hydraulic fluid therein with working fluid. Accordingly, dynamic annular fluid seals 119, 120, and 121 are respectively disposed in annular grooves 122, 124, and 126 in the upper end of the reduced diameter portion 52, the lower end of the intermediate portion 100, and the upper tubular portion 44 just below the shoulder 58.

In order to manipulate pressure in the tube 36 to achieve the pressure differential between the tube 36 and the annular chamber 38 necessary to expand the tube 36, the piston 90 must be moved longitudinally. Downward movement of the piston 90 reduces the volume of the annular chamber 104, thereby compressing the fluid in the coiled tube 36. Conversely, upward movement of the piston 90 increases the volume in the annular chamber 104 thereby decreasing the pressure in the coiled tube 36. This movement is achieved by selectively manipulating the pressure of the working fluid acting on the piston 90.

The skilled artisan will appreciate that the pressure $P_{Fluid}$ of the working fluid acting on the piston 90 is a function of the flow rate and density of the working fluid, the particular configuration of the bottomhole assembly 11, i.e. the sizes and number of tools, and the number and sizes of the orifices in the drill bit 20. When working fluid is pumped through the bottom hole assembly 11, pressure builds inside the bottomhole assembly 11, including the orienting tool 10, due to the flow restricting characteristics of the orifices. The pressure $P_{Fluid}$ inside the orienting tool 10 assumes a level that is a function of the aforementioned parameters.

For a given bottomhole assembly, the values of the pressure $P_{Fluid}$ in the orienting tool for particular flow rates and densities of working fluid, and the particular bottomhole assembly configuration, are normally calculated in advance of the drilling operation. Thus, the flow rate of working fluid may be varied to achieve a desired pressure $P_{Fluid}$ inside the orienting tool 10.

The fluid pressure $P_{Fluid}$ inside the orienting tool acts downward on the surface area $A_{94}$, and upward on the surface area $A_{111}$ of the shoulder 111, resulting in a net downward force that is a function of the difference in the areas $A_{94}$ and $A_{111}$. The pressure of the fluid $P_{110}$ in the annulus 28 acts upward on the surface area $A_{108}$ of the shoulder 108. However, $P_{110}$ is ordinarily negligible in relation to the pressure $P_{Fluid}$, and may be ignored. Thus, the net downward force exerted by the pressure $P_{Fluid}$ is counteracted by the static pressure $P_{36}$ of the hydraulic fluid in the tube 36 acting upward on the surface area $A_{102}$ of the shoulder 102.

The piston 90 is sized so that:

$$A_{94} = A_{108} + A_{111} + A_{102} \qquad \text{Equation (1)}$$

Accordingly, the relationship between the applied pressure $P_{Fluid}$ and the resulting pressure in the tube 36 $P_{36}$ is given by:

$$P_{36} = P_{Fluid} \cdot \frac{A_{94} - A_{111}}{A_{102}} \qquad \text{Equation (2)}$$

By raising the flow rate of the working fluid, the tube pressure $P_{36}$ may be increased to cause the tube 36 to expand and uncoil, thereby rotating the mandrel 32 clockwise. Conversely, by lowering the flow rate of the working fluid, the tube pressure $P_{36}$ may be decreased to cause the tube 36 to contract and coil, thereby rotating the mandrel 32 counterclockwise. It should be noted that the quantity $(A_{94}-A_{111})/A_{102}$ is a constant for a given orienting tool 10 and reflects the fact that the piston 90 acts as a pressure intensifier. For example, where the ratio $(A_{94}-A_{111})/A_{102}$ is equal to say 3 to 1 a given pressure $P_{Fluid}$ will cause a tube pressure $P_{36}$ that is three times greater.

The skilled artisan will appreciate that without a suitable mechanism to restrict the rotation of the mandrel 32, the tube 36 may coil or uncoil and rotate the mandrel 32 whenever the pressure $P_{Fluid}$ acting on the piston 90 is changed. Since rotation of the mandrel 32 is only desired during a deliberate and selective orienting operation, an arrangement of cooperating splines is provided to prevent the mandrel 32 from rotating when the orienting tool 10 is in the running position shown in FIG. 2 and to permit the mandrel 32 to rotate when the orienting tool 10 is in the orienting position shown in FIG. 3.

Referring now to FIGS. 2, and 4–8, the mandrel 32 is provided with a plurality of outwardly projecting, circumferentially spaced splines 128 disposed below the intermediate section 75. Each two adjacent splines, such as **128*a* and 128*b*, are circumferentially spaced apart an angle θ, the measure of which in degrees is equal to 360° divided by the number of splines 128. While the number of splines 128 is a matter of discretion for the designer, as detailed more below, the angle θ is a function of the number of splines 128, and represents the minimum change in rotational setting of the orienting tool 10. Thus, a relatively smaller number of splines 128** translates into a larger angle θ and a smaller number of possible rotational settings, and vice versa.

An upper annular collar 130 is slidably disposed around the mandrel 32 beneath the splines 128. The upper annular collar 130 has an upwardly projecting arcuate member 132 that does not engage the splines 128 so as to restrict rotation of the upper annular collar 130, and a downwardly projecting arcuate member 134 that is circumferentially offset counterclockwise from the upwardly projecting arcuate member 132. The upwardly and downwardly projecting arcuate members 132 and 134 need not be circumferentially offset.

A lower annular collar 136 is disposed beneath the upper annular collar 130. The lower annular collar 136 is provided with an upwardly projecting arcuate member 137 that is engageable with the downwardly projecting arcuate member 134. Relative rotational movement between the mandrel 32 and the lower annular collar 136 is prevented by a rectangular key 138 disposed in opposing longitudinal recesses 140*a* and 142 in the inner surface of the lower annular collar 136 and the outer surface of the mandrel 32. Thus, the lower annular collar 136 rotates with the mandrel 32.

During assembly of the mandrel 32, it desirable to impart a pretension to the tube 36 to ensure that the mandrel 32 returns to its zero position when the pressure $P_{Fluid}$ is removed. To impart the pretension, the lower annular collar 136 is slipped over the mandrel 32, and the mandrel 32 is manually rotated clockwise an initial amount to slightly uncoil the tube 36. To facilitate insertion of the key 138, a series of longitudinal recesses 143 identical to the recess 142 are circumferentially disposed in the outer surface of the mandrel 32 and an additional longitudinal recess 140*b* identical to the recess 140*a* is disposed in the inner surface of the lower annular collar 136. The recesses 140*a*, 140*b*, and 143 provide a number of possible arrangement of aligned recesses, such as 140*a* and 142, for convenient placement of the key 138 after the initial pretensioning rotation.

The lower tubular portion 64 is provided with a plurality of inwardly projecting and circumferentially spaced splines 144 disposed near the longitudinal midpoint of the lower tubular portion 64. The splines 144 are dimensioned to mate with the plurality of splines 128 and prevent rotation of the mandrel 32 when the orienting tool 10 is in the running position shown in FIG. 2. An additional plurality of inwardly projecting and circumferentially spaced splines 146 is disposed beneath the plurality of splines 144. Each of the splines 146 is longitudinally aligned with one of the corresponding splines 144. However, the splines 146 do not extend around the entire circumference of the lower tubular portion 64. Rather, an arcuate gap $\psi$ is provided between splines 146*a* and 146*b*. The gap $\psi$ is provided to accommodate circumferential movement of the upwardly projecting arcuate member 132, with the splines 146*a* and 146*b* respectively defining the limits of permissible clockwise and counterclockwise movement of the upwardly projecting arcuate member 132. As seen more clearly in FIG. 5, the gap $\psi$ between the splines 146*a* and 146*b* and the width of the upwardly projecting member 132 are chosen to enable the upwardly projecting arcuate member 132, and thus the upper annular collar 130, to rotate clockwise or counterclockwise through an angle $\Omega$. The significance and selection of angle $\Omega$ is detailed below.

The skilled artisan will appreciate that when the orienting tool 10 is the orienting position shown in FIG. 3, the splines 128 will be disposed between the splines 144 and the splines 146, and the mandrel 32 will be free to rotate clockwise. If the pressure in the tube 36 is great enough, the mandrel 32 will rotate until the leading edge 148 of the upwardly projecting member 137 engages the trailing edge 150 of the downwardly projecting member 134. The widths of the upwardly projecting arcuate member 137 and the downwardly projecting member 134 would ordinarily limit the permissible rotation of the mandrel 32 to something less than 360°. However, the presence of the gap $\psi$ enables the mandrel 32 to rotate past the point where the leading edge 148 engages the trailing edge 150 through angle $\Omega$ until the upwardly projecting arcuate member 132 engages the spline 146*a*.

Because the annular chamber 38 is vented to the annulus 28 via ports 85, materials in the annulus 28, such as drilling mud, may migrate into the annular chamber 38. It is desirable to provide such materials a flow path past the mandrel 32. Accordingly, sufficient clearances are provided between surfaces of the mandrel 32 and the various components associated therewith, such as the splines 128 and the upper annular collar 130, and the lower tubular portion 64 and the various components associated therewith, such as the splines 144, to enable materials accumulating in the annular chamber 38 to flow past the mandrel 32.

The operation of the orienting tool 10 with the bottom hole assembly 11 in a drilling environment may understood by reference to FIGS. 1–3 and 8. At the surface, the orienting tool 10 is filled with hydraulic fluid at atmospheric pressure as described above and sent downhole with the bottomhole assembly 11. With the drill bit 20 resting on the bottom of the bore 12 and weight placed on the drill string 11 as shown in FIG. 1, the orienting tool 10 assumes the running position shown in FIG. 2. In the running position depicted in FIG. 2, the engagement of splines 128 and splines 144 prevent the mandrel 32 from rotating.

Working fluid is then pumped from the surface down the bottomhole assembly 11 and out the drill bit 20. The mud motor powering the drill bit 20 will ordinarily require a threshold pressure in the working fluid in order to begin rotation. Accordingly, the working fluid is delivered with a flow rate sufficient to meet the mud motor's minimum starting pressure. That initial pressure of the working fluid will increase the pressure in the tube 36 according to Equation 2 above. The bottomhole assembly 11 must be lifted off bottom temporarily to start the mud motor. When weight is lifted off of the bottomhole assembly 11 to start the mud motor, the housing 34 will slide upward relative to the mandrel 32, thereby placing the orienting tool 10 into the orienting position shown in FIG. 3. As a result of the threshold pressure applied to start the mud motor, the mandrel 32 will rotate clockwise to a new equilibrium position. The amount of rotation will be proportional to the threshold pressure. This new position represents the zero point for subsequent orienting movements. This initial angular movement of the mandrel 32 will effectively reduce the total available rotation of the mandrel 32. Accordingly, the above-referenced gap $\psi$, between splines 146*a* and 146*b* may be chosen to provide an additional amount of available mandrel rotation equal to the initial amount of rotation caused by the threshold pressure applied. As the drill bit 20 begins to rotate, weight is again placed on the bottomhole assembly 11, thereby moving the housing 34 downward in relation to the mandrel 32, placing the orienting tool 10 back into the running position shown in FIG. 2.

Now assume for the purposes of illustration that it is desired to change the path of the drill bit 20, by moving the stabilizer 26 clockwise through a given angle. To do so, weight is again removed from the bottomhole assembly 11 to place the orienting tool 10 in the orienting position as shown in FIG. 3. The pressure in the tube 36 is increased to achieve the desired amount of rotation by increasing the flow rate of working fluid to achieve a pressure $P_{Fluid}$ acting on the piston 90 sufficient to achieve the necessary pressure in the tube 36. The amount of rotation obtained for a given change in working fluid flow rate may be determined by using a measurement-while-drilling (MWD) tool in the bottomhole assembly 11 to sense rotation. After the desired rotation of the mandrel 32 is accomplished, weight is again placed on the drill string to return the orienting tool 10 to the running position shown in FIG. 2.

If, conversely, counterclockwise rotation of the mandrel 32 is desired, weight is removed from the bottomhole assembly 11 to place the orienting tool 10 in the orienting position shown in FIG. 3, and the flow rate of the working fluid is reduced in an amount sufficient to enable the mandrel 32 to rotate counterclockwise the desired amount.

Figure 9:
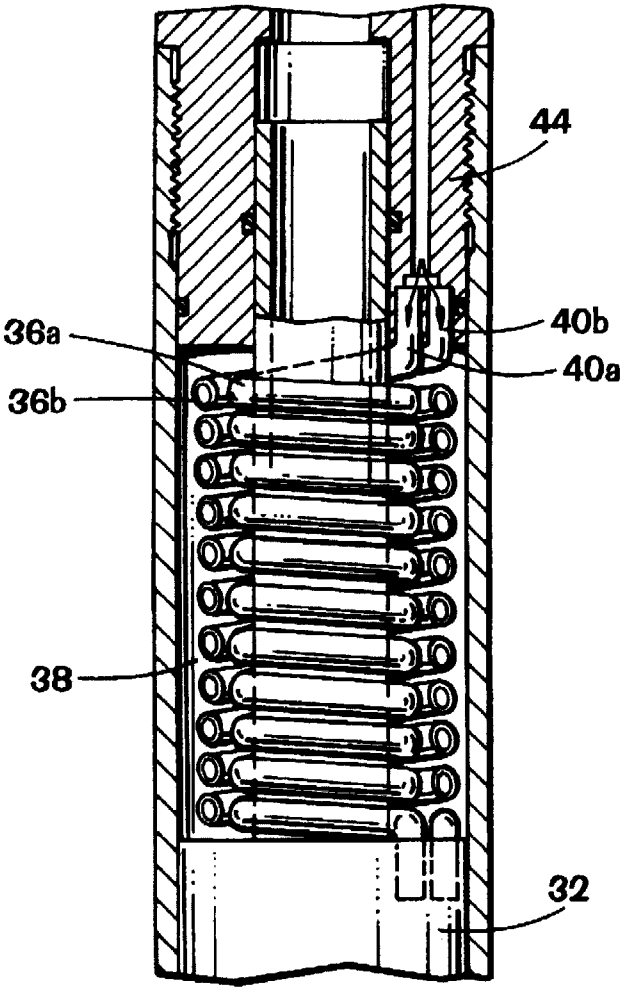
FIG. 9 illustrates a portion of an alternate embodiment of the orienting tool, in section, and showing an alternative nested arrangement for the coiled tubes.
Figure 10:
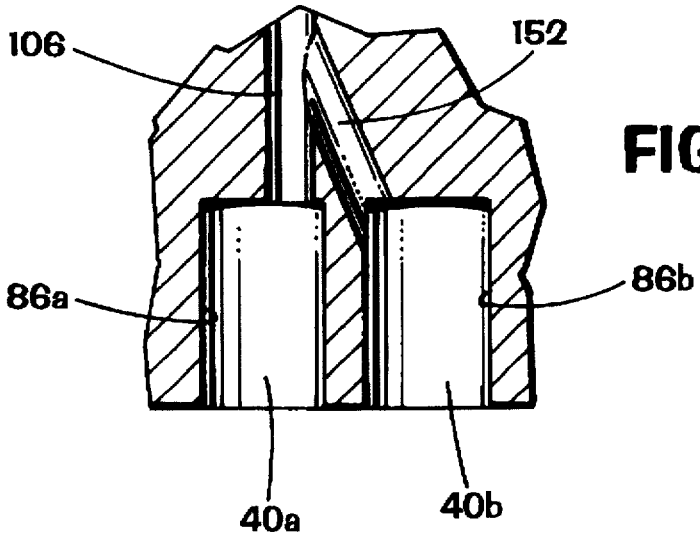
FIG. 10 illustrates a detailed view from FIG. 9, showing the connection of the coiled tubes to the housing, in section.

The amount of torque applied to the mandrel 32 for a given orienting tool 10 may be increased by providing more than one tube in the annular chamber 38. In one alternate preferred embodiment, the orienting tool 10 is provided with two nested coiled tubes 36*a* and 36*b* disposed in the annular chamber 38 as shown in FIG. 9. The diameter of the coils of the tube 36*a* is smaller than the diameter of the coils of the tube 36*b* so that the tube 36*a* is nested within the tube 36*b*. As in the previously disclosed preferred embodiment, the tubes 36*a* and 36*b* have their respective upper ends 40*a* and 40*b* attached disposed in bores 86*a* and 86*b* to the lower end of the upper tubular portion 44. The upper end 40*a* is in fluid communication with the flow passage 106. The upper end 40*b* is also in fluid communication with the flow passage 106 by way of a feed passage 152 that extends from the flow passage 106 to the upper end 40*b*.

Figure 11:
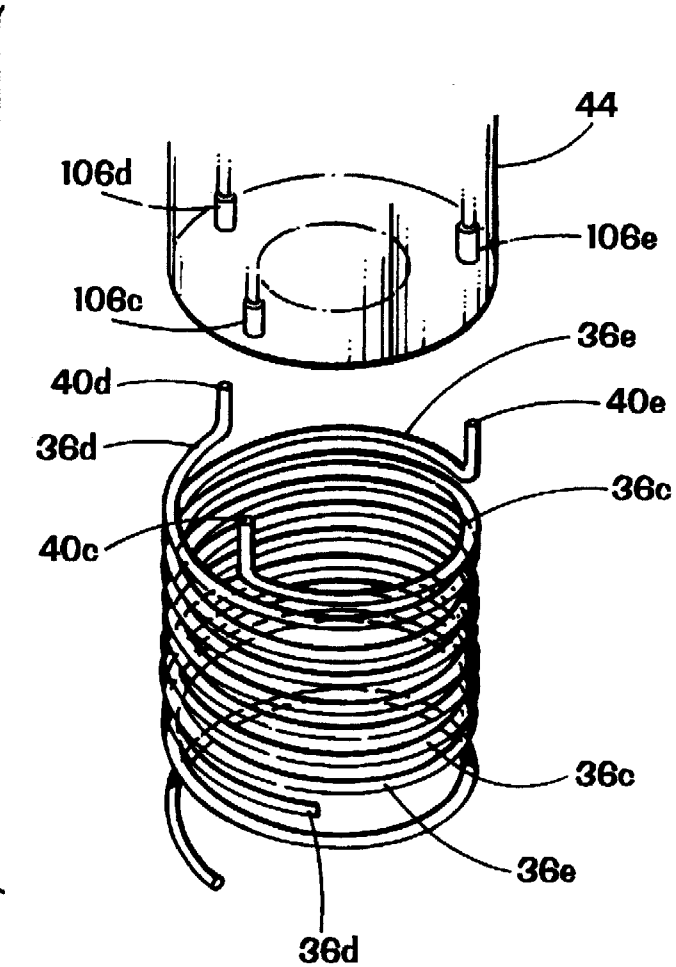
FIG. 11 illustrates another alternate embodiment of the orienting tool, in section, and showing an alternative nested arrangement for the coiled tubes.
Figure 12:
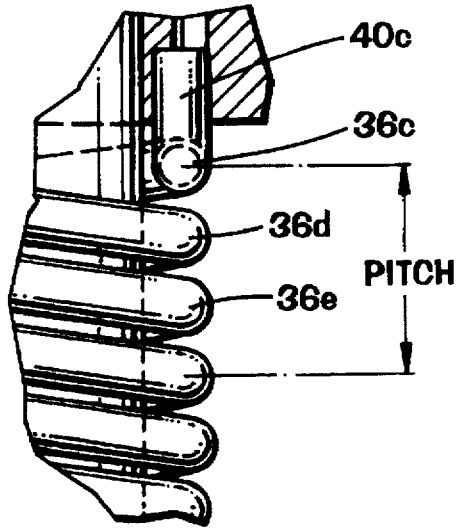
FIG. 12 illustrates a detailed view from FIG. 11, showing the pitch of the nested coiled tubes.

In another alternate preferred embodiment utilizing multiple tubes, three tubes, 36*c*, 36*d*, and 36*e*, are provided in a nested arrangement as shown in FIGS. 11 and 12. The upper ends 40*c*, 40*d*, and 40*e* are circumferentially spaced to couple to the lower end of the upper tubular potion 44 at equal circumferential intervals. The upper ends 40*c*, 40*d*, and 40*e* are respectively in fluid communication with correspondingly circumferentially spaced flow passages 106*c*, 106*d*, and 106*e*. The flow passages 106*c*, 106*d*, and 106*e* extend to the annular chamber 104, not shown in FIGS. 11 and 12, but readily apparent from FIGS. 2 or 3. Unlike the aforementioned alternate preferred embodiment utilizing multiple tubes, the alternate preferred embodiment depicted in FIGS. 11 and 12 does not utilize tubes of differing coil diameter to achieve the nested arrangement. Rather, the tubes 36*c*, 36*d*, and 36*e* all have approximately the same coil diameter. The nested arrangement is achieved by nesting the helical coils vertically as shown in FIGS. 11 and 12. The pitch of a given tube, such as 36*c*, as indicated in FIG. 12, is chosen to accommodate the coils of the other tubes 36*d* and 36*e* as shown in FIG. 12.

Operationally, the above two alternate preferred embodiments operate identically to the first mentioned preferred embodiment.

Although a particular detailed embodiment of the apparatus has been described herein, it should be understood that the invention is not restricted to the details of the preferred embodiment, and many changes in design, configuration, and dimensions are possible without departing from the spirit and scope of the invention.

We claim:

1. A tool for effectuating relative rotational movement between two spaced apart sections of a bottomhole assembly, comprising:

a housing;

a mandrel having a first end disposed within said housing, said mandrel and said housing defining an annular chamber; and flexible metallic coiled tube disposed within said annular chamber and containing a fluid, said tube having a first end coupled to said housing and a second end coupled to said mandrel, said tube being operable to selectively rotate said mandrel relative to said housing in response to a change in the pressure of said fluid.

2. The tool of claim 1 further comprising:

a piston movably disposed within said housing, said piston and said housing defining a first fluid chamber; and at least one passage extending from said chamber to said tube to enable fluid communication between said tube and said first chamber.

3. The tool of claim 1, wherein said housing includes a plurality of circumferentially spaced inwardly projecting splines; and said mandrel includes one outwardly projecting spline to prevent relative rotation between said mandrel and said housing;

said orienting tool having a running position wherein said outwardly projecting spline is disposed between any two adjacent of said plurality of inwardly projecting splines, and an orienting position wherein said outwardly projecting spline is not disposed between any two adjacent of said plurality of inwardly property splines.

4. The tool of claim 1, wherein said housing includes an inwardly projecting spline; and said mandrel includes a plurality of outwardly projecting splines, said orienting tool having a running position wherein said inwardly projecting spline is disposed between any two adjacent of said plurality of outwardly projecting splines to prevent relative rotation between said mandrel and said housing, and an orienting position wherein said inwardly projecting spline is not disposed between any two adjacent of said plurality of outwardly projecting splines to permit relative rotation between said mandrel and said housing.

5. The tool of claim 2, wherein said piston and said housing define a second fluid chamber, said second fluid chamber being ported to the exterior of said housing.

6. An orienting tool for insertion into a well bore comprising:

a housing having a fluid passage disposed therein;

a mandrel having a first end disposed within said housing;

said mandrel and said housing defining an annular chamber, said annular chamber being vented to the exterior of said housing;

flexible metallic coiled tube disposed within said annular chamber, said tube having a first end coupled to said housing and being in fluid communication with said fluid passage, and a second end coupled to said mandrel, said tube being operable to rotate said mandrel relative to said housing in response to a change in the pressure of said fluid; and a piston movably disposed within said housing, said piston and said housing defining a first fluid chamber, said first fluid chamber being in fluid communication with said fluid passage, wherein longitudinal movement of said piston effects said change in said pressure of said fluid.

7. The orienting tool of claim 6, wherein said housing includes a plurality of circumferentially spaced inwardly projecting splines; and said mandrel includes one outwardly projecting spline;

said orienting tool having a running position wherein said outwardly projecting spline is disposed between any two adjacent of said plurality of inwardly projecting splines, and an orienting position wherein said outwardly projecting spline is not disposed between any two adjacent of said plurality of inwardly property splines.

8. The orienting tool of claim 6, wherein said housing includes an inwardly projecting spline; and said mandrel includes a plurality of outwardly projecting splines, said orienting tool having a running position wherein said inwardly projecting spline is disposed between any two adjacent of said plurality of outwardly projecting splines to prevent relative rotation between said mandrel and said housing, and an orienting position wherein said inwardly projecting spline is not disposed between any two adjacent of said plurality of outwardly projecting splines to permit relative rotation between said mandrel and said housing.

9. The tool of claim 7, wherein said piston and said housing define a second fluid chamber, said second fluid chamber being ported to the exterior of said housing.

10. An orienting tool for insertion into a well bore, comprising:

a housing having a plurality of inwardly projecting splines;

a mandrel having a first end disposed within said housing, and a second end being adapted for coupling to a downhole tool, said housing being longitudinally moveable relative to said mandrel between a running position and an orienting position, said mandrel and said housing defining an annular chamber, said annular chamber being vented to the exterior of said housing, said mandrel having at least one outwardly projecting spline being adapted to be selectively disposed between any two of said plurality of inwardly projecting splines when said housing is in said running position;

a flexible metallic coiled tube disposed within said annular chamber and containing a fluid, said tube having a first end coupled to said housing, and a second end coupled to said mandrel, said tube being operable to rotate said mandrel relative to said housing in response to a change in the pressure of said fluid; and a piston movably disposed within said housing, said piston and said housing defining a first fluid chamber in fluid communication with said first end of said tube, and a second fluid chamber, said second fluid chamber being vented to the exterior of said housing, wherein longitudinal movement of said piston effectuates said change in pressure of said fluid.

11. The orienting tool of claim 10, which includes a second flexible metallic coiled tube disposed within said annular chamber and containing a fluid, said tube having a first end coupled to said housing and in fluid communication with said first fluid chamber, and a second end coupled to said mandrel.

12. The orienting tool of claim 11, which includes a third flexible metallic coiled tube disposed within said annular chamber and containing a fluid, said tube having a first end coupled to said housing and in fluid communication with said first fluid chamber, and a second end coupled to said mandrel.

13. The orienting tool of claim 10, wherein said uphole end of said housing is coupled to a first downhole tool and said downhole end of said mandrel is coupled to a second downhole tool.

14. The orienting tool of claim 13, wherein said second downhole tool is a MWD sub.

* * * * *